US007210716B2

(12) United States Patent
Mueller et al.

(10) Patent No.: US 7,210,716 B2
(45) Date of Patent: May 1, 2007

(54) MOVEMENT PREVENTION DEVICE

(75) Inventors: Hans-Guenther Mueller, Wuerzburg (DE); Joseph J. Bella, Plainfield, IL (US); Steven L. Bivens, Kankakee, IL (US); David A. Doornbos, Manteno, IL (US)

(73) Assignee: Illinois Tool Works Inc., Glenview, IL (US)

( * ) Notice: Subject to any disclaimer, the term of this patent is extended or adjusted under 35 U.S.C. 154(b) by 123 days.

(21) Appl. No.: 11/091,642

(22) Filed: Mar. 28, 2005

(65) Prior Publication Data

US 2005/0280266 A1 Dec. 22, 2005

Related U.S. Application Data

(60) Provisional application No. 60/576,778, filed on Jun. 3, 2004.

(51) Int. Cl.
*E05B 3/00* (2006.01)

(52) U.S. Cl. ..... 292/336.3; 292/DIG. 22

(58) Field of Classification Search ..... 292/347, 292/336.3, DIG. 22
See application file for complete search history.

(56) References Cited

U.S. PATENT DOCUMENTS 5,669,642 A * 9/1997 Kang ..... 292/336.3
6,460,904 B1 * 10/2002 Stapf ..... 292/336.3
6,464,270 B1 * 10/2002 Sloan et al. ..... 292/336.3
6,572,159 B2 * 6/2003 Lambertz et al. ..... 292/336.3

* cited by examiner

*Primary Examiner*—Gary Estremsky
(74) *Attorney, Agent, or Firm*—Mark W. Croll; Paul F. Donovon

(57) ABSTRACT

A movement prevention device for a vehicle door latch mechanism includes a body movable between blocking and non-blocking positions in response to sudden changes in inertia on the vehicle, such as during a side impact crash. The device interferes with movement of the handle to prevent unintended opening of the latch mechanism.

9 Claims, 4 Drawing Sheets

MOVEMENT PREVENTION DEVICE

CROSS-REFERENCE TO RELATED APPLICATIONS

The present regular U.S. Patent Application claims the benefits of U.S. Provisional Application Ser. No. 60/576,778 filed on Jun. 3, 2004.

FIELD OF THE INVENTION

The present invention relates generally to automobile door handle mechanisms and, more particularly, the invention pertains to structures in such mechanism for inhibiting unintended movement of the mechanism and unintended opening of the door during a crash, such as a side impact crash.

BACKGROUND OF THE INVENTION

Exterior door handle mechanisms for automobiles are provided in a variety of designs so that the shape and operation thereof compliment and add to the overall design and appearance of the automobile. Accordingly, door handles are provided in a variety of vertical and horizontal orientations. Some are provided recessed within the door panel. In operating a variety of door handle mechanisms, the exposed handle is lifted, pulled or otherwise moved to activate the latch mechanism. When the handle is released, a spring assists in returning the door handle to the closed position in which the latch mechanism engages to hold the door closed.

In some known constructions, a latch lever is connected to a latch cable that is also connected to the latch mechanism designed to secure the door in a closed position. In one such known design, the lever pivots about a substantially horizontal axis. The latch lever has a center of gravity spaced significantly below the lever pivotal axis. The lever is rotated about the pivotal axis and biased by a spring such that, when the door handle is released, the latch lever is returned to a lowered position which places the cable in position for the latch mechanism to be secured, holding the door closed and latched.

In spite of the biasing influence of a spring or counterweight structures in the door mechanism, a side impact crash can cause movement of the latch lever from the closed position toward the opened position. A significant side impact crash can cause the latch lever to move completely to the unlatch position, even without either the exterior door handle or the interior door handle having been actuated intentionally. This condition can potentially cause the door to unlatch, possibly allowing the door to swing open. An open door condition during a crash or roll-over exposes occupants of the vehicle, thereby increasing the possibility of injury to the occupants, including possible ejection.

As a result, manufacturers are concerned with providing latch mechanisms that secure the door in closed positions even when side impact or roll-over crashes occur. However, any such securing structure must not render the door unduly difficult to open during normal use.

SUMMARY OF THE INVENTION

The present invention provides a latch locking structure that is actuated by the crash event itself, not interfering with normal latch operation except in the event of a crash. Locking structure is moved by the force from the crash to engage the latch mechanism in such a way as to prevent unintended opening or release of the latch mechanism.

In one aspect thereof, the present invention provides a latch mechanism with a handle having a pivot about which the handle is rotated. The handle has a latch position and an unlatch position when rotated about the pivot. A movement prevention device associated with the handle is movable between a non-blocking position and a blocking position in response to sudden change in inertia on the mechanism. The non-blocking position of the movement prevention device permits unrestricted movement of the handle between the latch and unlatch positions. The blocking position of the movement prevention device interferes with movement of the handle from the latch position to the unlatch position. A biasing means urges the movement prevention device to the non-blocking position.

In another aspect thereof, the present invention provides a latch mechanism with a handle movable between closed and opened positions. A gear segment is connected to the handle and is moved upon movement of the handle. A gear damper has a rotor with a shaft and a gear disposed on the shaft. The gear is drivingly engaged with the gear segment. A movement prevention device is moveable between blocking and non-blocking positions. The movement prevention device includes structure interfering with movement of one of the gear segment and the gear when the movement prevention device is in the blocking position.

In a still further aspect thereof, the present invention provides a movement prevention device for a door latch mechanism. The device includes a body moveable between blocking and, non-blocking positions and has structure positioned to interfere with operation of the latch mechanism only when the body is in the blocking position. A biasing means urges the body to the non-blocking position. The biasing means and the body are configured to yield to sudden significant changes in inertia, allowing the body to move from the non-blocking position to the blocking position.

An advantage of the present invention is providing a movement prevention device for automobile door latches that does not interfere with normal operation of the latch mechanism for ingress and egress of occupants.

Another advantage of the present invention is providing a movement prevention device for automobile door latches that is actuated by the force of a side impact or rollover crash to secure the latch in a closed position and prevent accidental disengagement of the latch mechanism.

Yet another advantage of the present invention is providing a movement prevention device that can be incorporated into the latch mechanisms of other things, devices and structures such as bins, console doors, trays and the like in automobiles, other transport devices or structures other than vehicles.

Other features and advantages of the invention will become apparent to those skilled in the art upon review of the following detailed description, claims and drawings in which like numerals are used to designate like features.

Figure 2:
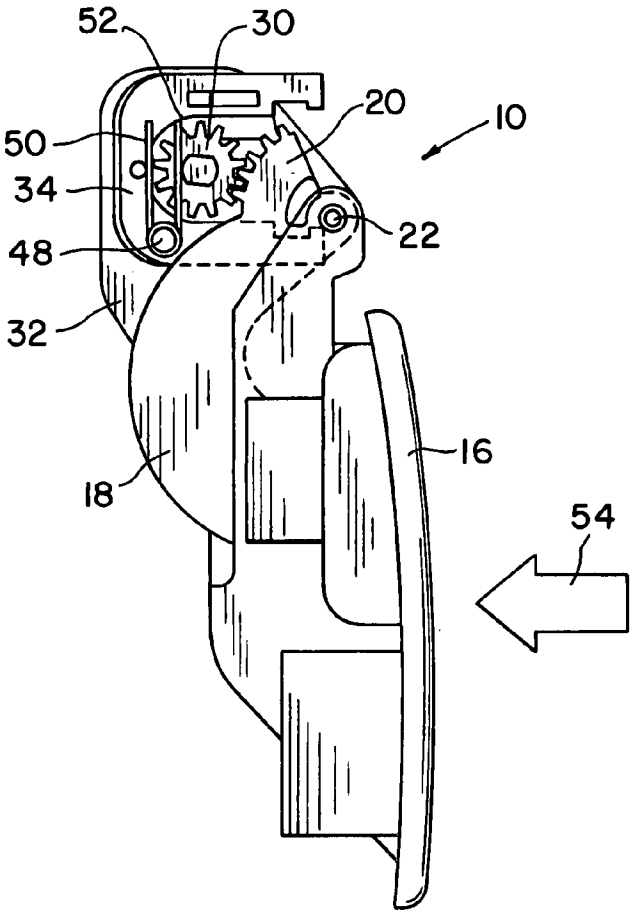
FIG. 2 is an elevational view similar to that of FIG. 1 but illustrating the movement prevention device in a locking condition such as during a side impact or roll-over crash.

Before the embodiments of the invention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein are for the purpose of description and should not be regarded as limiting. The use herein of "including", "comprising" and variations thereof is meant to encompass the items listed thereafter and equivalents thereof, as well as additional items and equivalents thereof.

DETAILED DESCRIPTION OF THE PREFERRED EMBODIMENT

Referring now more specifically to the drawings and to FIGS. 1–4 in particular, numeral 10 designates a vehicle latch assembly in which a movement prevention device 12 is operatively associated with a damper 14. Damper 14 is provided to control or dampen the movement of the door handle during normal use of vehicle latch assembly 10, as a door having latch assembly 10 is opened and closed for ingress and egress of occupants and things. Device 12 is provided cooperatively associated with damper 14 to inhibit unintended opening of latch assembly 10 in the event of a side impact crash, rollover or other occurrence that provides excessive side force on the vehicle and latch assembly 10.

Latch assembly 10 includes a lift-type handle 16 including an arm 18 having a gear sector 20 thereon. Handle 16 is pivotable about a horizontal axis 22. Pivotal movement of handle 16 about axis 22 upwardly and downwardly causes movement of gear sector 20 through an arc between the fully open and fully closed positions of handle 16. Elevation of handle 16 actuates a latch mechanism (not shown) connected thereto to release a door having assembly 10 installed therein from a latched condition.

Figure 1:
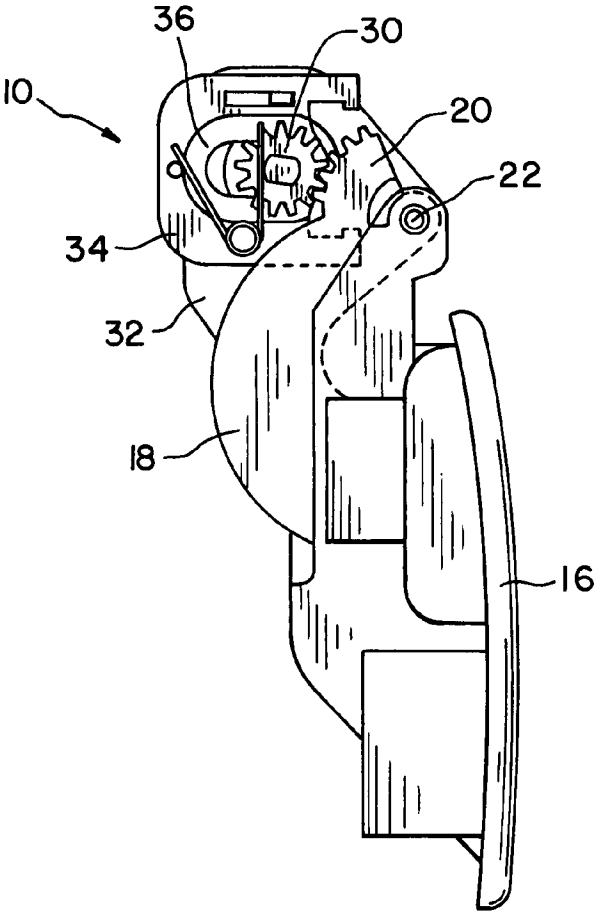
FIG. 1 is a side elevational view of a door handle mechanism having a movement prevention device in accordance with the present invention, the device shown in a state of normal operation.

Damper 14 is a gear damper having a housing 24 and a rotor 26 disposed therein. Gear dampers suitable for the present invention are known in many applications and can be provided for controlling and damping movement in one or both directions of rotation of rotor 26 relative to housing 24. A shaft 28 from rotor 26 extends outwardly from housing 24 and has a gear 30 mounted thereon. Gear damper 14 is mounted in a support 32 within the door substantially parallel to axis 22. Gear 30 on rotor shaft 28 is drivingly engaged with gear sector 20 of arm 18. Thus, as handle 16 is raised or lowered and gear sector 20 moves through the arc defined thereby, gear sector 20 and gear 30 are in driving connection one with the other. Movement of handle 16 thereby turns rotor 26 relative to housing 24, and the damping effect provided by damper 14 is conveyed through gear 30 to gear sector 20 and thus to the rotation of handle 16 about axis 22. Damper 14 thereby controls movement of handle, and can be used to urge handle 16 to the lowered position in which the latch mechanism is secured. Under normal driving and use conditions, damper 14 holds handle 16 in the lowered position, Device 12 is operatively associated with damper 14. A sliding plate 34 defines an elongated central slot 36 by which plate 34 is disposed on and about shaft 28 from rotor 26. Gear 30 is disposed on shaft 28, with plate 34 retained between gear 30 and damper housing 24. A pair of elongated guide slots 38, 40 are provided on opposite sides of central slot 36. Guide pins 42, 44 are received in slots 38, 40, respectively. A spring 46 is provided beneath plate 34, mounted on a spring post 48. Spring 46 includes legs 50, 52 disposed against shaft 28 and an end of plate 34. Spring 46 biases plate 34 to a disengaged position allowing operation of latch assembly 10 in normal manner. The normal operating position of latch mechanism 10 is illustrated in FIG. 1, wherein plate 34 can be seen biased to the left as illustrated in FIG. 1.

A side impact or roll-over condition is illustrated in FIG. 2, with the force being designated by arrow 54. The change in inertia from the force of the event has overcome the biasing force of spring 46, causing slide plate 34 to move to the right relative to the other structures of latch assembly 10, as illustrated in FIG. 2. Relative movement of slide plate 34 is directed by guide pins 42, 44 in slots 38, 40 and by central slot 36 around shaft 28.

Figure 4:
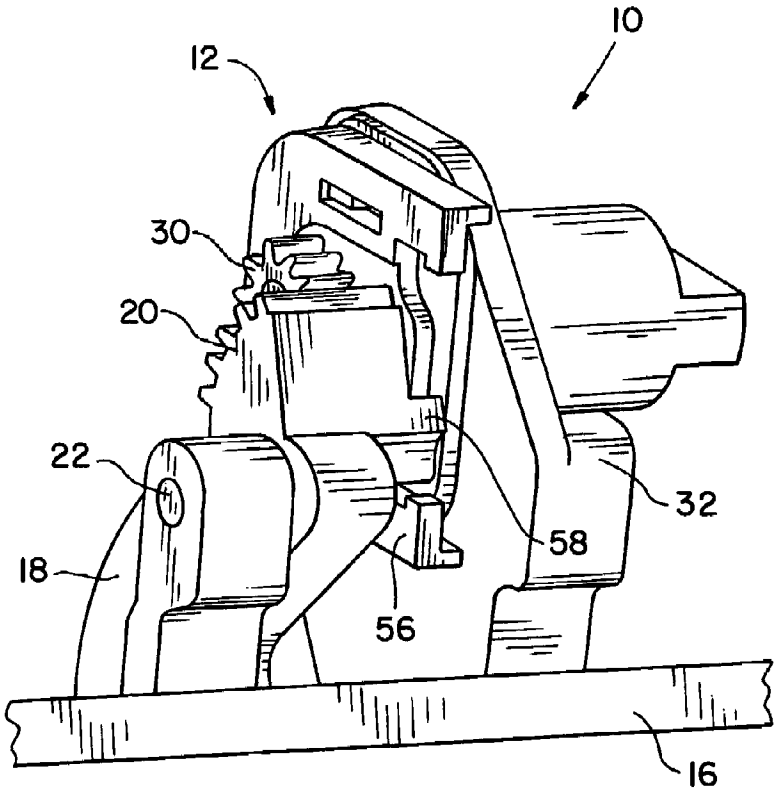
FIG. 4 is a perspective view of the door handle and movement prevention device, shown from an angle different from that of FIGS. 1 and 2.
Figure 3:
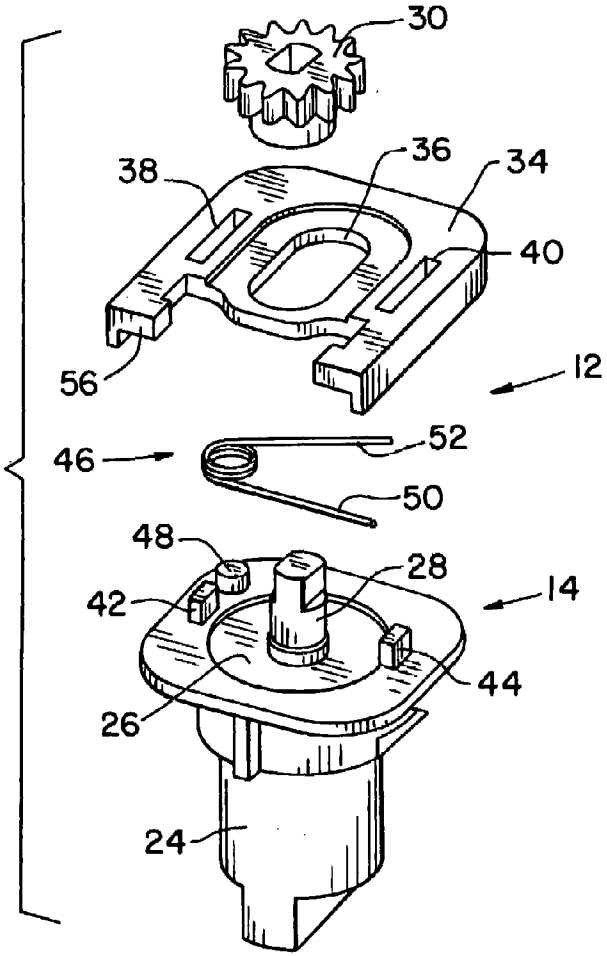
FIG. 3 is an exploded view of the movement prevention device shown in FIGS. 1 and 2.

Ends of plate 34 opposite the side engaged by spring 46 project outwardly on the top and bottom, having an open end in between the projections. As illustrated in FIG. 4, a bottom projection 56 extends beneath arm 18 when plate 34 is moved relative to the remainder of latch assembly 10. Arm 18 can be provided with a stopper extension portion 58 which overlies bottom projection 56 when plate 34 is moved to the position shown in FIGS. 2 and 4. In this position of plate 34, arm 18 is not able to move in that stopper portion 58 is blocked by bottom projection 56. Thus, with rail-like projection 56 in the position illustrated in FIGS. 2 and 4, handle 16 cannot move and a door latch mechanism operated by handle 16 will not become disengaged unintentionally.

Figure 6:
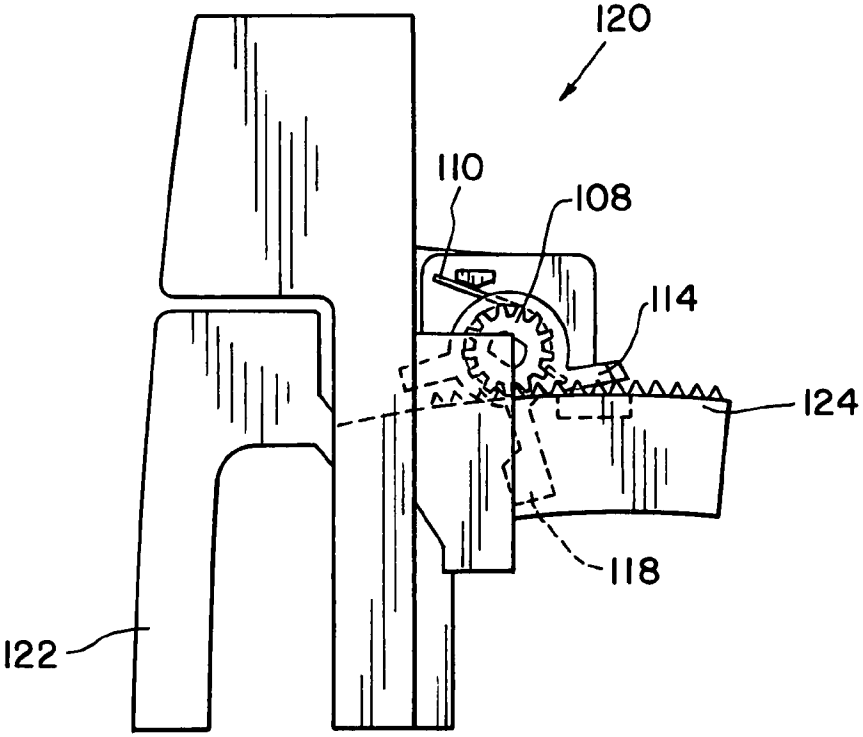
FIG. 6 is an elevational view of the embodiment of FIG. 5, shown installed in a vehicle door mechanism, with the movement prevention device illustrated in a condition of normal operation.
Figure 5:
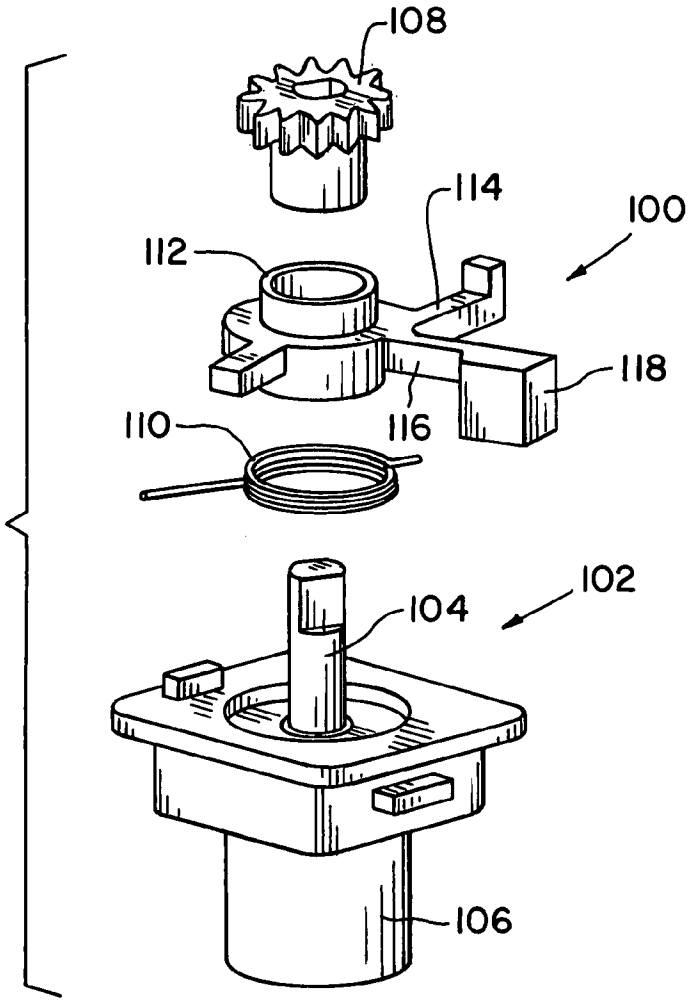
FIG. 5 is an exploded view of another embodiment of a movement prevention device in accordance with the present invention.
Figure 7:
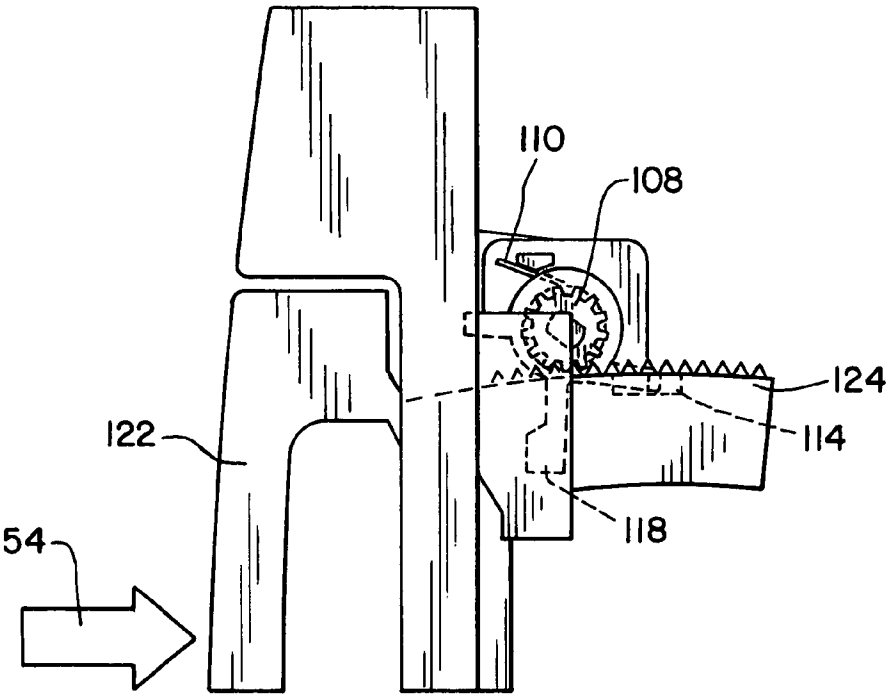
FIG. 7 is an elevational view similar to that of FIG. 6, but illustrating the position of the movement prevention device during a crash.

Device 12 in accordance with the present invention can be modified for operation with a variety of different door structures and door handle arrangements. FIGS. 5, 6 and 7 illustrate another embodiment of the present invention. Device 100 is operatively associated with a damper 102. Again, device 100 is mounted on a rotor shaft 104 of damper 102, between a housing 106 and a damper gear 108 of damper 102. A spring 110 biases device 100 towards the disengaged position so that a handle mechanism on which it is mounted operates without interruption. Device 100 includes a central body 112 rotatable about shaft 104, and outwardly extending arms 114 and 116. Arm 116 defines an enlarged outer end 118 operating as a counter-weight to rotation of mechanism 100.

FIGS. 6 and 7 illustrate the normal (FIG. 6) and impact (FIG. 7) conditions for device 100 in a vehicle latch mechanism 120. Latch mechanism 120 includes a handle 122, the operation of which moves a gear rack 124. During normal conditions, device 100 has no influence on the operation of latch mechanism 120. Handle 122 is moved as necessary, and damper 102 provides the desired damping effect to the movement of handle 122. The cooperative interaction of damper gear 108 and gear rack 124 conveys the damping influence of damper 102 to the movement of handle 122. Upon a side impact or roll-over condition, as illustrated in FIG. 7, device 110 is rotated such that arm 114 engages rack 124, inhibiting movement of rack 124. Thus, without rack 124 being able to move handle 122 does not move, and the latch mechanism is secured in a closed condition.

Figure 8:
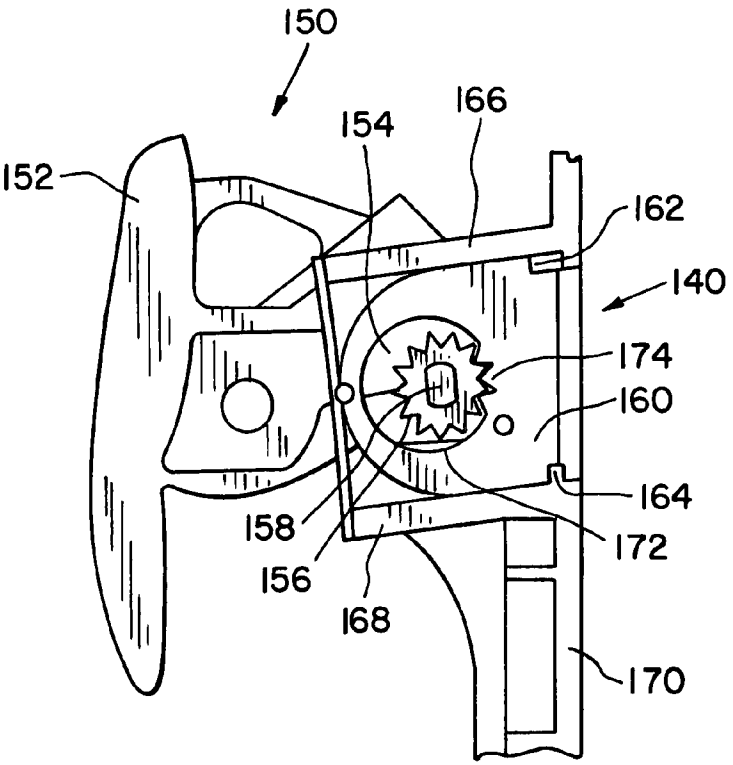
FIG. 8 is an elevational view of yet another form of movement prevention device in accordance with the present invention, the device shown in a door latch mechanism and in a condition of locking engagement for preventing unintended unlatch of the door.

FIG. 8 illustrates yet another embodiment for a movement prevention device 140 of the present invention as part of a door latch mechanism 150. Latch mechanism 150 includes a handle 152 operated for engaging and disengaging a latch (not shown). A damper 154 is provided in similar fashion to dampers 14 and 102 described previously. A damper gear 156 on a damper shaft 158 operatively engages structure (not shown) associated with handle 152 so that movement of handle 152 is contained and controlled as desired:

Movement prevention device 140 includes a plate 160 having edge portions 162, 164 operating in slots 166, 168 defined in a housing structure 170. Plate 160 defines a central opening 172 having a toothed section 174 therein. In a side impact or roll-over condition as illustrated in FIG. 8, plate 160 slides along slots 166, 168 defined in structure 170 such that toothed section 174 engages gear 156. Accordingly, gear 156 is prevented from rotating, and because of the direct linkage of gear 156 to handle 152, handle 152 cannot move when gear 156 is prevented from rotating.

Each of the mechanisms described herein include structure which moves as a result of the change in inertia that occurs during a side impact collision, roll-over, or other such event. A portion of the moved structure engages or at least inhibits movement of structure associated with the handle of the vehicle door. Since the structure is required to move in order for the latch mechanism to disengage, by inhibiting movement of the relevant structure, the door handle cannot move and the latch does not become disengaged unintentionally.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. A latch mechanism comprising:

a handle having a pivot about which said handle is rotated, said handle having a latch position and an unlatch position when rotated about said pivot;

a movement prevention device associated with said handle and movable between a non-blocking position and a blocking position in response to sudden change in inertia on said mechanism, said non-blocking position of said movement prevention device permitting unrestricted movement of said handle between said latch and unlatch positions, and said blocking position of said movement prevention device interfering with movement of said handle from said latch position to said unlatch position;

biasing means urging said movement prevention device to said non-blocking position;

an arm connected to said handle and having a gear segment which is moved upon movement of said handle;

a gear damper having a rotor and a gear thereon, said gear drivingly engaged with said gear segment;

said movement prevention device interfering with movement of at least one of said gear and said gear segment in response to sudden change in inertia on said mechanism;

said movement prevention device comprising a sliding plate associated with said damper and having a projection blocking movement of said arm when in said blocking position; and said plate defining slots and said damper having pins disposed in said slots for guiding movement of said plate.

2. A latch mechanism comprising:

a handle having a pivot about which said handle is rotated, said handle having a latch position and an unlatch position when rotated about said pivot;

a movement prevention device associated with said handle and movable between a non-blocking position and a blocking position in response to sudden change in inertia on said mechanism, said non-blocking position of said mavoement prevention device permitting unrestricted movement of said handle between said latch and unlatch positions, and said blocking position of said movement prevention device interfering with movement of said handle from said latch position to said unlatch position;

biasing means urging said movement prevention device to said non-blocking position;

an arm connected to said handle and having a gear segment which is moved upon movement of said handle;

a gear damper having a rotor and a gear thereon, said gear drivingly engaged with said gear segment; and said movement prevention device interfering with movement of at least one of said gear and said gear segment in response to sudden change in inertia on said mechanism;

said movement prevention device being a body rotatably relative to said damper and having an arm engageable with said gear segment so as to interfere with movement of said gear segment when said movement prevention device is in said blocking position.

3. A latch mechanism comprising:

a handle having a pivot about which said handle is rotated, said handle having a latch position and an unlatch position when rotated about said pivot;

a movement prevention device associated with said handle and movable between a non-blocking position and a blocking position in response to sudden change in inertia on said mechanism, said non-blocking position of said movement prevention device permitting unrestricted movement of said handle between said latch and unlatch positions, and said blocking position of said movement prevention device interfering with movement of said handle from said latch position to said unlatch position;

biasing means urging said movement prevention device to said non-blocking position;

an arm connected to said handle and having a gear segment which is moved upon movement of said handle;

a gear damper having a rotor shaft and a gear thereon, said gear drivingly engaged with said gear segment; and said movement prevention device interfering with movement of at least one of said gear and said gear segment in response to sudden change in inertia on said mechanism;

channels defined in said latch mechanism; and said movement prevention device being a body having edges slidably disposed in said channels.

4. The latch mechanism of claim 3, said body having teeth for engaging said gear.

5. A latch mechanism comprising:

a handle movable between closed and opened positions;

a gear segment connected to said handle and moved upon movement of said handle;

a gear damper having a rotor with a shaft and a gear disposed on said shaft, said gear being drivingly engaged with said gear segment;

a movement prevention device moveable between blocking and non-blocking positions, said movement prevention device including structure interfering with movement of one of said gear segment and said gear when said movement prevention device is in said blocking position;

said movement prevention device being a sliding plate; and said sliding plate having teeth engaging said gear in said blocking position.

6. A latch mechanism comprising:

a handle movable between closed and opened positions;

a gear segment connected to said handle and moved upon movement of said handle;

a gear damper having a rotor with a shaft and a gear disposed on said shaft, said gear being drivingly engaged with said gear segment;

a movement prevention device moveable between blocking and non-blocking positions, said movement prevention device including structure interfering with movement of one of said gear segment and said gear when said movement prevention device is in said blocking position;

said movement prevention device being a sliding plate; and said sliding plate having a portion thereof engageable with said gear segment so as to interfer with movement of said gear segment when said plate is in a blocking position.

7. A latch mechanism comprising:

a handle movable between closed and opened positions;

a gear segment connected to said handle and moved upon movement of said handle;

a gear damper having a rotor with a shaft and a gear disposed on said shaft, said gear being drivingly engaged with said gear segment;

a movement prevention device moveable between blocking and non-blocking positions, said movement prevention device including structure interfering with movement of one of said gear segment and said gear when said movement prevention device is in said blocking position;

said movement prevention device being a sliding plate; and said plate having edges guided in channels.

8. A latch mechanism comprising:

a handle movable between closed and opened positions;

a gear segment connected to said handle and moved upon movement of said handle;

a gear damper having a rotor with a shaft and a gear disposed on said shaft, said gear being drivingly engaged with said gear segment; and a movement prevention device moveable between blocking and non-blocking positions, said movement prevention device including structure interfering with movement of one of said gear segment and said gear when said movement prevention device is in said blocking position;

said movement prevention device being a sliding plate; and said plate disposed on said shaft and defining a slot guided in movement by a pin on said damper.

9. A latch mechanism comprising:

a handle movable between closed and opened positions;

a gear segment connected to said handle and moved upon movement of said handle;

a gear damper having a rotor with a shaft and a gear disposed on said shaft, said gear being drivingly engaged with said gear segment;

a movement prevention device moveable between blocking and non-blocking positions, said movement prevention device including structure interfering with movement of one of said gear segment and said gear when said movement prevention device is in said blocking position;

said movement prevention device being a body rotable relative to said damper; and said body being rotable about said shaft, and having an arm engageable with said gear segment so as to interfere with movement of said gear segment in said blocking position.

* * * * *